US006940783B2

(12) United States Patent
Fox et al.

(10) Patent No.: US 6,940,783 B2
(45) Date of Patent: Sep. 6, 2005

(54) MAT FOR TIMING COMPETITIONS

(75) Inventors: Robert W. Fox, Castle Rock, CO (US); John L. Goers, Castle Rock, CO (US)

(73) Assignee: Speed Stacks, Inc., Englewood, CO (US)

( * ) Notice: Subject to any disclaimer, the term of this patent is extended or adjusted under 35 U.S.C. 154(b) by 208 days.

(21) Appl. No.: 10/172,652

(22) Filed: Jun. 14, 2002

(65) Prior Publication Data

US 2003/0231554 A1 Dec. 18, 2003

(51) Int. Cl.[7] ..... G04B 47/00; G04F 8/00; A63B 67/00; A63B 71/00

(52) U.S. Cl. ..... 368/10; 368/110; 368/113; 273/441; 273/445

(58) Field of Search ..... ; G04B 47/00; G04F 8/00; A63B 67/00, 71/00

(56) References Cited

U.S. PATENT DOCUMENTS 3,649,010 A * 3/1972 Jeffrey et al. ..... 273/452
3,878,675 A * 4/1975 Prociuk ..... 368/10
4,220,330 A * 9/1980 Montgomery ..... 273/452
4,392,176 A 7/1983 Kneip et al. ..... 361/160
4,518,266 A * 5/1985 Dawley ..... 368/10
4,586,709 A 5/1986 Godinet ..... 273/86
4,700,369 A * 10/1987 Siegal et al. ..... 377/24.2
4,703,930 A 11/1987 Gilbert ..... 273/1
4,818,234 A * 4/1989 Redington et al. ..... 434/247
5,019,950 A 5/1991 Johnson ..... 362/130
5,057,965 A 10/1991 Wilson ..... 361/212
5,652,975 A 8/1997 Hoskin ..... 4/661
5,838,638 A * 11/1998 Tipton et al. ..... 368/10
5,844,861 A * 12/1998 Maurer ..... 368/10
5,933,102 A 8/1999 Miller et al. ..... 341/33
6,181,647 B1 * 1/2001 Tipton et al. ..... 368/10
6,229,764 B1 * 5/2001 Tongue ..... 368/110

* cited by examiner

*Primary Examiner*—Vit W. Miska
(74) *Attorney, Agent, or Firm*—Sheridan Ross P.C.

(57) ABSTRACT

The present invention describes an apparatus and method for timing manual dexterity and hand-eye coordination competitions. Specifically, the present invention relates to an apparatus and method for timing cup stacking competitions. The apparatus of the present invention includes a mat which may incorporate a timer and the cups which are to be stacked on the mat.

43 Claims, 4 Drawing Sheets

MAT FOR TIMING COMPETITIONS

FIELD OF THE INVENTION

This application relates generally to an apparatus and method for use in timing competitive play and more specifically to an apparatus for use in the timing of cup stacking competitions.

BACKGROUND OF THE INVENTION

Cup stacking first became popular in the mid 90s as a method of teaching physical coordination, including hand-to-eye coordination, to youngsters. Cup stacking helps students use both sides of their bodies and brains, develop ambidexterity, develop quickness, and improve concentration. Cup stacking also helps teach sequencing and patterning, which can help in developing math and reading skills. Since the mid 90s, the sport has grown in popularity throughout the country, primarily in elementary schools, where it has become a part of many physical education programs. The sport involves stacking and unstacking a set of specially designed cups in pre-arranged sequences while being timed. The object of the competitions is to complete the sequence or sequences in as short a time as possible. There are several standard sequences and the competitions can be performed by an individual or by a team in a relay fashion.

Timing of the competition is usually performed by a judge with a stopwatch. The competitor begins with both hands face down on the table where the cups are to be stacked. The judge gives a verbal cue, usually "Ready, Get Set, Go", starting the stopwatch on the word GO. Time is stopped when the last cup is down stacked in the particular sequence.

One of the major drawbacks to the sport has been the inaccuracy associated with having different individuals time the competitors using stopwatches. Errors in timing due to variations in human reaction time often exceed several tenths of a second and are significant (as much as 10% off) when measuring competitive times. Competitive times in this sport range from 2 to 15 seconds with winners of the competition usually determined by hundredths of seconds. To mitigate against the human reaction time, in final competitions, three judges are used and the high and low times are not counted against the competitor. This measure, however, is inefficient and does not cure the inaccuracies inherent with using human judges since the measured time to complete the sequence is still subjective.

Another drawback to the sport is the surface on which the cups are stacked. At present, there are no surfaces which are the same for competitions. Some tournaments use tables covered with short nap carpeting while others use a standard Formica table top. In addition, the competitors do not always have access to the competition surface in order to practice their sport in a competitive environment. This lack of consistency among the surfaces upon which the cups are stacked is a further problem for competitive cup stackers.

SUMMARY OF THE INVENTION

Each of the embodiments of the present invention described herein solves both the timing problem and the surface problem described above. Each of the embodiments includes a mat. The mat of the present invention may provide a consistent surface upon which cups are to be stacked. The present invention includes an embodiment where the mat is used as a surface upon which cups are stacked in a cup stacking competition or in practice for a cup stacking competition.

Most of the embodiments of the present invention also include a timing mechanism. The timing mechanism may be incorporated into the mat or otherwise be associated with the mat. In either case, the timing mechanism solves the inaccuracies associated with utilizing human judges.

One embodiment of the present invention describes an apparatus comprising support means, trigger means connected to the support means, and timing means operatively connected to the trigger means. Another embodiment of the present invention describes an apparatus comprising a mat, a pressure sensitive trigger connected to the mat, and a timer operatively connected to the trigger so that the timer begins to accrue time with a first activation of the trigger and stops with a second activation of the trigger.

Yet another embodiment of the present invention describes a system that has an apparatus and a plurality of cups. The apparatus of this embodiment comprises a mat, a trigger connected to the mat, and a timer operatively connected to the trigger so the timer begins to accrue time with a first activation of the trigger and stops with a second activation of the trigger.

The present invention also includes a method of timing a competition which comprises arming a trigger connected to a mat and operatively connected to a timer, starting the timer, completing the tasks on the mat, and stopping the timer. The present invention further includes a method of cup stacking utilizing a plurality of cups comprising placing a mat on a table or desk, stacking the plurality of cups on the mat, and unstacking the plurality of cups on the mat.

These and other objects, features, and advantages of the invention will become apparent from the following best mode description, the drawings and the claims.

BRIEF DESCRIPTION OF THE DRAWINGS

The figures which follow depict a preferred embodiment of the invention, and may depict various alternative embodiments. The invention is not limited to the embodiment or embodiments depicted herein since even further various alternative embodiments will be readily apparent to those skilled in the art. For the ease of the reader, like reference numerals in various drawing figures refer to identical structural elements or components.

Figure 1:
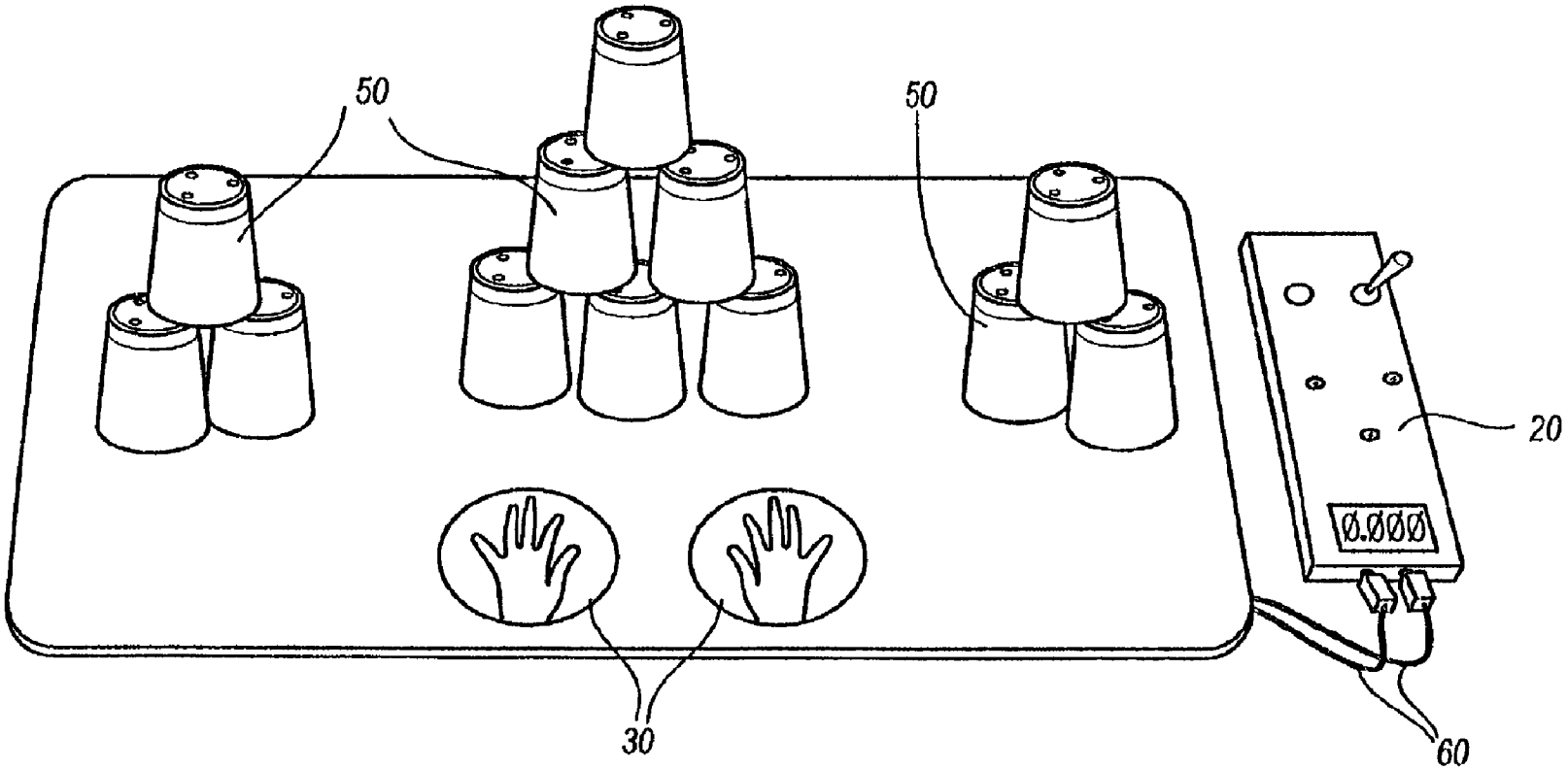
FIG. 1 depicts a top perspective view of the components of one embodiment of the invention.

For the ease of the reader in referring to the drawings, the following component list is provided:

| | |
|---|---|
| Mat | 10 |
| Foam backing | 11 |

-continued

| | |
|---|---|
| Fabric Surface | 12 |
| Timer | 20 |
| Readout Display | 21 |
| Wire/Trace Connectors | 22 |
| Power Switch | 24 |
| Reset Button | 23 |
| Indicator Lights | 25 and 27 |
| "ARM" Light | 26 |
| Trigger | 30 |
| Film Covering | 33 |
| Traces | 34 |
| Cups | 50 |
| Wires | 60 |

DETAILED DESCRIPTION OF THE INVENTION

At the outset, it should be understood that this invention comprises a method and an apparatus for timing competitions, particularly, competitions focusing on hand eye coordination and manual dexterity and, more particularly, cup stacking competitions. The description which follows describes a preferred embodiment of the invention, and various alternative embodiments. It should be readily apparent to those skilled in the art, however, that various other alternative embodiments may be accomplished without departing from the spirit or scope of the invention.

The apparatus of the present invention uses a support member that can be placed on a table or other surface used for cup stacking competitions. Suitable support members include but are not limited to mats, pads, cushions, rugs, and the like. The support member is, preferably, a mat. The mat of the present invention can be made from any material that will provide a non-slip surface on the side of the mat that contacts the desk or other competition table and a smooth, even surface on the reverse side. One should note that the smooth and even side of the mat should not be too slick as the cups will be stacked on this surface of the mat and it is important that the cups not slip when placed on the mat. The mat can be made from various types of fabric (whether the fabric is used alone or in combination with a backing), various types of short nap carpeting, closed cell foam, vinyl covered surfaces, any combination of these, and the like.

It has been found that "mouse pad" material works well for the purposes of the present invention. The "mouse pad" material has a fabric surface bonded to a foam substrate or backing. The foam backing gives the mat integrity, while providing flexibility and a soft feel to the mat. The foam backing is also water resistant and provides a stable base throughout the life of the mat. The foam backing typically used in mouse pads is a closed cell foam, which also works with the present invention. As with mouse pads, the foam backing used in the present invention should have non-skid properties. These properties will allow the mat to be placed on a table or other surface and will prevent the mat from sliding while the cups are being stacked and unstacked.

The fabric surface provides a stacking surface that is smooth and even, yet does not allow the cups to stick to or slide. This is an important feature for the fabric surface because, if the fabric surface is too sticky, the stacking process may be negatively impacted. Conversely, if the fabric surface is too slippery, the cups will slide easily and cannot be quickly stacked. The fabric surface can be made of any fabric; for most mouse pads, a polyester fabric is used. However, a flocked fabric surface could also be suitable. In addition, the fabric surface can be imprinted or designed in various ways by any known methodology. Designs can include but are not limited to the school colors, mascots, and the like.

The mat can easily be stored by simply rolling the material into a tube. In addition, a bag or enclosure for housing the mat while it is not in use can be provided. The bag can be designed to house only the mat or the bag can be designed to house more, such as the cups and a timer. The mat can have bands or ties which will help secure and keep the mat in a rolled position, similar to the way that such bands or ties are used on sleeping bags.

It should be noted that the invention contemplates using the mat alone, either while the cup stacker is learning how to stack, practicing the stacking or competing in a cup stacking competition. In most of the embodiments of the present invention, the mat is connected to at least one trigger mechanism, which, in turn, is connected to a timer mechanism. The trigger mechanism starts and stops the timer. The mat can incorporate the trigger so that the mat and trigger form an integral unit or the trigger can be located apart from the mat. The trigger can be any type of trigger that will start and stop a timer, including but not limited to capacitive switches, inductive switches, photoelectric or photo optic sensors, dry contact switches or conductive contact points. The trigger should also meet the following criteria: 1) an extremely low profile so that the trigger(s) does not interfere with cup stacking; 2) tuned to filter out false signals, such as a cup being placed on the trigger; 3) covered with a film or other covering to keep the trigger safe from environmental conditions; 4) small amounts of pressure should be sufficient for the trigger to operate; and 5) be inexpensive. It has been found that a capacitive touch trigger or pressure sensitive trigger works well with the present invention. In addition, it has been found that, for the purposes of cup stacking competitions, two touch pad triggers work well. However, it should be noted that any number of touch pad triggers can be used with the present invention. For example, for use with a relay event in cup stacking, the mat can incorporate four or more touch pad triggers to allow each competitor in the relay team access to their own set of touch pad triggers. In addition, an array of sensors can also be created which allows the competitor to place two hands anywhere within a specified boundary to trigger the timer. This array can be constructed using any of the aforementioned types of sensors or any combination of the aforementioned sensors.

Figure 4:
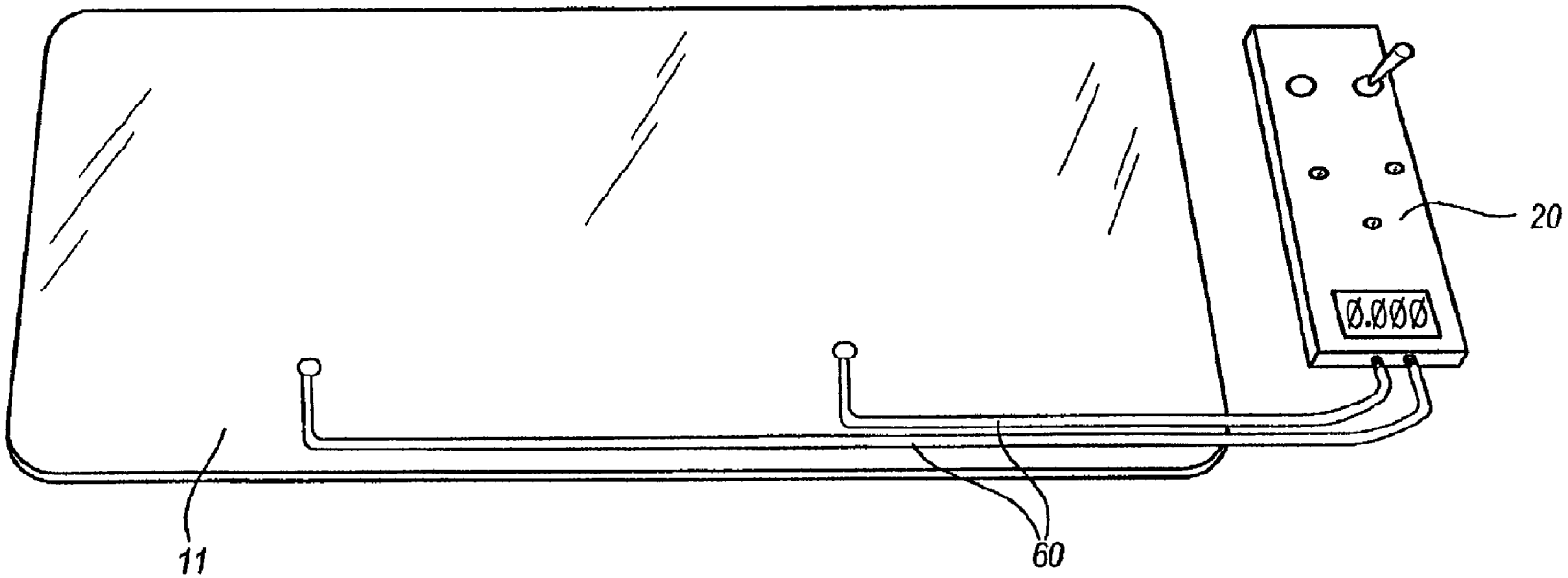
FIG. 4 depicts a bottom perspective view of the components of one embodiment of the invention.

In one embodiment, the touch pad triggers are formed by printing conductive ink traces to the backside of a film covering. The traces conduct a signal generated from the touch pad triggers to a timer. The trigger area is formed by increasing the circular area of the trace. Thus, in this embodiment, the trigger is part of the trace. Wires are connected to the traces to conduct the signals generated to the timer. The film covering has an adhesive backing which adheres the film to the mat. The film covering can be made of any material. It has been found that Mylar works well as the film covering. In this embodiment, the traces are printed on the backside of the film covering and conduct signals from the trigger section to the timer mechanism. The wires can run along the bottom of the mat (the surface that will be laid on the table) as shown in FIG. 4, or can be built into the mat so that the wires are not visible from the back of the mat. Conductive traces can also be used instead of wires and can be built into the mat so that the traces are not visible from the back of the mat. The film covering can be adhered directly on top of the top surface of the mat. One of skill in the art will recognize other means of securing the touch pad triggers to the mat and it should be understood that all means of securing the touch pad triggers to the mat are specifically contemplated by the inventors for use with the present invention.

The timer mechanism can be any kind of timer that meets the following criteria: 1) is capable of timing to at least 0.01 seconds; 2) able to be started and stopped by the competitor without reliance on any third party; 3) predictable, repeatable, reusable, and reliable; 4) does not interfere with the stacking process; and 5) able to be operated using a free standing power source, such as batteries, for long periods of time without resort to auxiliary power sources. A timer found suitable for use with the present invention includes a timer constructed from standard electronic components, including a microprocessor to accurately keep time, an LED display, discrete light emitting diodes, a reset switch, a power switch and a power source. The power switch is shown in the figures as a toggle switch; however, it should be noted that type of switch is appropriate for use in the present invention. It may be preferable to have the power switch and the reset switch be different types of switches so that competitors and judges do not get confused over which switch accomplishes which function. The timer is, preferably, powered by batteries to allow for maximum portability of the mat and timer; however, the invention can incorporate a power coupling to allow the timer to be connected to a power supply or other suitable power source.

As shown in FIG. 1, the cup stacking system is comprised of a mat 10, a timer 20, touch pad triggers 30, wires 60 connecting the timer 20 to the touch pad triggers 30, and a plurality of cups 50. FIG. 1 depicts a set of twelve cups arranged in the 3-6-3 position. FIG. 1 shows the timer as a separate unit from the mat, while the triggers are incorporated into the mat. It should be noted that the triggers can be a separate unit from the mat. It should also be noted that the triggers and the timer can be incorporated into the mat to form an integral unit.

Figure 2:
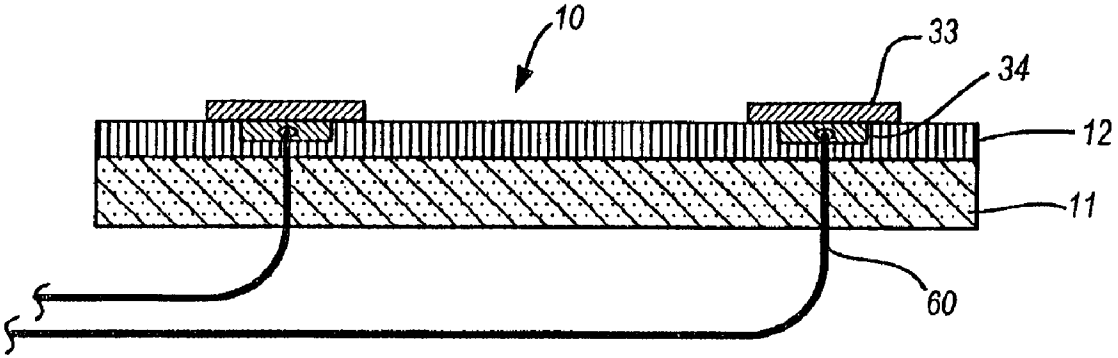
FIG. 2 depicts a side view of the mat of one embodiment of the present invention.
Figure 3:
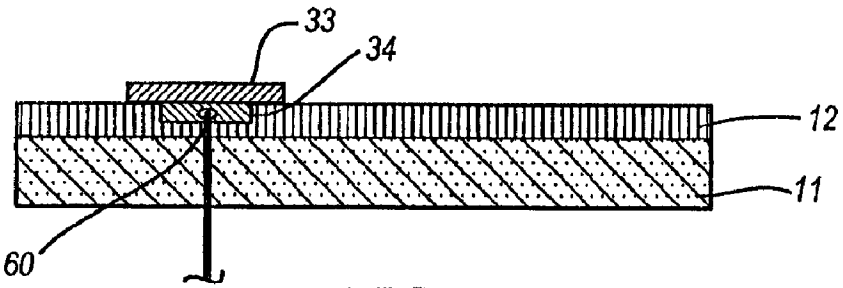
FIG. 3 depicts another side view of the mat of one embodiment of the present invention.

FIG. 2 shows a mat made from "mouse pad" material from one side of the mat where both touch pad triggers 30 can be seen. The foam backing 11 is bonded to the fabric surface 12 of the mat 10. The touch pad trigger, comprising the film covering 33 and the capacitive antenna 34, are placed on the fabric surface 12 of the mat 10. The trace or wire 60 is connected to the capacitive antenna 34 and is also connected to the timer through the wire connectors 22 (shown in FIG. 5). FIG. 3 depicts the same elements but from the side view where only one of touch pad triggers is shown.

Figure 5:
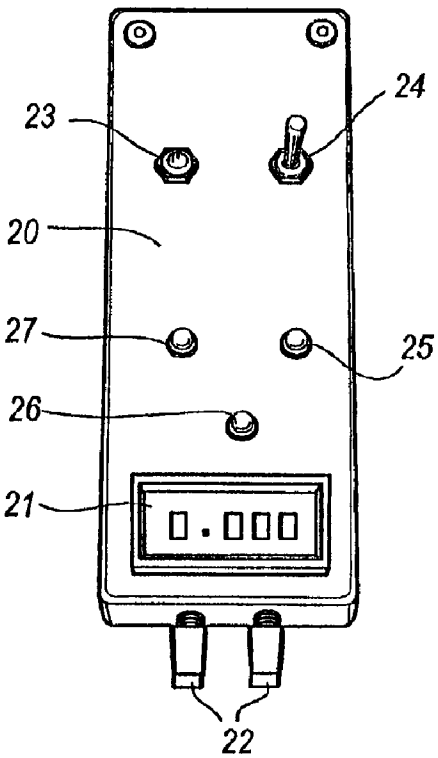
FIG. 5 depicts a top view of the timer of one embodiment of the present invention.

FIG. 5 shows the timer 20 of one embodiment of the present invention. The timer in FIG. 5 is shown separated from the mat but may be attached to the mat in another embodiment. The timer has a power switch 23, which can be any kind of switch that will allow electricity to flow through the circuit board and the various elements of the timer. The timer 20 has a readout display 21 where the time is shown. The timer 20 is connected to the touch pad triggers 30 through the wire connectors 22. This connection may be through wires as shown or through conductive traces. The timer 20 has, in this embodiment, two indicator LEDs 25 and 27, each of which corresponds to one of the touch pad triggers, and will illuminate when pressure is sensed by a touch pad trigger. Alternately, a single LED may be used to indicate the presence of both hands. When pressure is applied to the touch pad triggers 30 for longer than one second, an arming LED 26 is illuminated. The arming LED 26 indicates to the competitor that the timer is ready and the competition can be begin. The timer 20 is triggered by releasing the touch pad triggers 30. The timer 20 is stopped by applying pressure again to the touch pad triggers 30. The timer can be reset by utilizing the reset switch 23. The reset switch can be a push button, a flip switch or any other appropriate switch.

A competitor will use the mat by first placing both hands on the touch pad triggers 30. Indicator lamps or light emitting diodes 25 and 27 (shown in FIGS. 1 and 5) will light up to show that each touch pad has been activated. Alternatively, a single LED may also be used to indicate the presence of both hands. Once both hands are in place for a full second, an arming lamp or light emitting diode 26 is illuminated to show that the timer is armed and ready for the competitor to begin. Although this embodiment utilizes light emitting diodes to show the competitor that the timer is armed and ready to begin, one of skill in the art can envision other means of notifying the competitor that the timer is armed, including but not limited to an audible indicator or a flashing light.

The competitor's hands will then leave the touch pad triggers, starting the timer. A readout display 21 indicates the amount of time that has passed. Once the sequence has been completed, both of the competitor's hands must again rest on the touch pad triggers. This will stop the timer. The final time remains on the readout display to allow the time to be recorded. To begin another timed sequence, the competitor or a judge pushes a reset button 23.

It should be appreciated that the timer could easily be connected, in any suitable manner, to a remote time display devices that would compute time or store time, such as a computer, or other electronic device that stores information (a palm pilot, etc.). In such an arrangement, a data cable would connect the timer which would be connected to the computer or other device (not shown). A computer program can direct the computer to begin accruing time when the trigger is activated, to stop accruing time when the trigger is reactivated, or the computer could simply display the time as calculated by the timer. Once time is stopped, the computer program could direct the judge or competitor to store the time or to delete the time.

Figure 6:
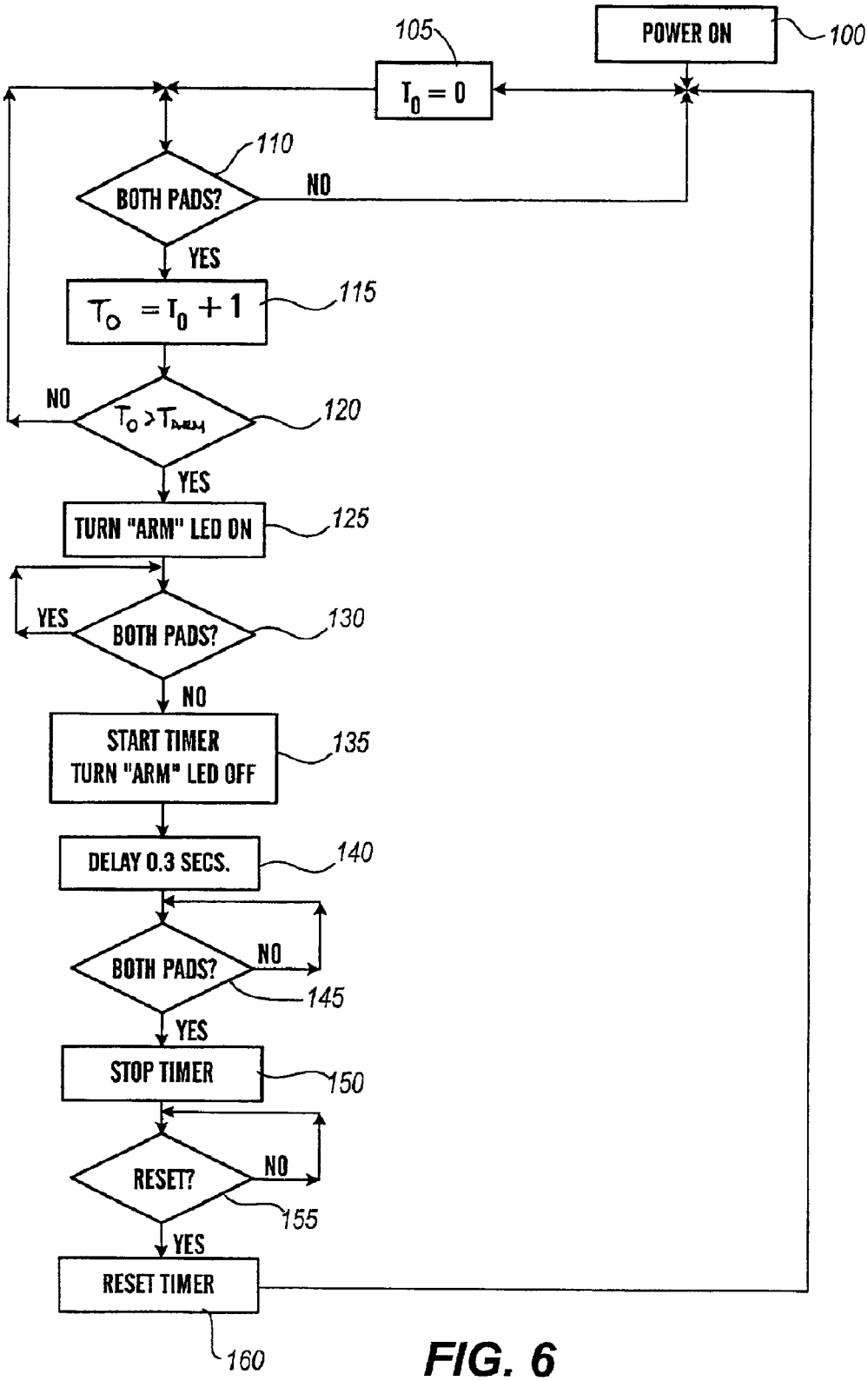
FIG. 6 depicts a flowchart of the operation of the timer of one embodiment of the present invention.

The flowchart for the timing mechanism of one embodiment of the present invention is shown in FIG. 6. The power is turned on in step 100. The timer then sets a variable $T_0$ to be zero in step 105. When the variable, $T_0$ is zero, the light emitting diodes are off. The touch pad triggers are activated by placing the hands of the competitor on or over the triggers and the microprocessor of the timer analyzes whether both touch pad triggers are activated, step 110. When both triggers are activated, the microprocessor adds 1 to the value of $T_0$ in step 115, then compares the value of $T_0$ to another preset variable, $T_{arm}$, in step 120. The microprocessor then determines whether $T_0$ is greater than $T_{arm}$, step 120. If not, the microprocessor reverts to step 110. If $T_0$ is greater than $T_{arm}$, the microprocessor directs current to the "ARM" light emitting diode, illuminating the diode, as shown in step 125. If not, the process begins again at step 110 until both pads have been activated for the required time $T_{arm}$.

The hands must be removed from both pads in order to move from the "ARM" state to accruing time. The "ARM" LED is the signal for the competitor to begin the competition. Once the competitor notices the illumination of the "ARM" LED, the competitor is then free to remove both hands from the touch pad triggers. Then, the microprocessor checks whether both touch pad triggers are activated, in step 130. If the pads are not activated, the "ARM" LED is turned off and the timer is started, step 135. A delay is built into this embodiment of the present invention, step 140. This delay prevents errant starting of the timer by the competitor if the competitor's hands were to leave the pads for less than 0.3 seconds. The delay of 0.3 seconds shown in step 140 is a debounce timer that does not affect the accumulating time of the competitor. The purpose of the delay is to eliminate errant STOP signals that could occur as the competitor's hands are leaving the triggers. Since actual competitive times of less than 0.3 seconds are not likely, the delay does not interfere with the function of the device and does not affect the measured time.

When the touch pad triggers are reactivated, the microprocessor checks to ensure that reactivation occurs on both touch pad triggers, step 145. If not, the timer keeps accruing time. If so, the timer is stopped, step 150. The final time is displayed on the display readout until the reset button is pressed, steps 155 and 160. Once the timer is reset, the variable $T_0$ is set back to zero and the timer is ready to time another competition.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing best mode of carrying out the invention should be considered exemplary in nature and not as limiting to the scope and spirit of the invention as set forth in the appended claims.

We claim:

1. An apparatus for timing cup stacking competitions comprising:

a mat;

a trigger connected to the mat, the trigger having two distinct pads, wherein the trigger is unaffected by the cup stacking;

a timer operatively connected to the trigger wherein a first activation of the trigger starts the timer and a second activation of the trigger stops the timer, wherein the first activation and the second activation require substantially simultaneous contact with the two distinct pads of the trigger.

2. The apparatus of claim 1 wherein the trigger is a pressure sensitive switch.

3. The apparatus of claim 1 wherein the trigger is a capacitive switch.

4. The apparatus of claim 1 wherein the trigger is a photo optic or photo electric switch.

5. The apparatus of claim 1 wherein the trigger is a dry contact switch.

6. The apparatus of claim 1 wherein the trigger is an inductive switch.

7. The apparatus of claim 1 wherein the trigger is comprised of a plurality of switches operated in parallel or in series.

8. The apparatus of claim 1 wherein the trigger and the timer are incorporated into the mat to form an integral unit.

9. The apparatus of claim 1 wherein the mat has a non-slip surface on one side and a smooth, even surface on the reverse side.

10. The apparatus of claim 1 wherein the mat is made from fabric, fabric with a substrate, fabric with a backing, short nap carpet, closed cell foam, vinyl with a substrate or any combination of these.

11. The apparatus of claim 1 wherein the mat is comprised of a foam substrate and a fabric surface.

12. The apparatus of claim 11 wherein the fabric surface of the mat is a polyester fabric or a flocked fabric.

13. The apparatus of claim 11 wherein the fabric surface is imprinted with a design.

14. The apparatus of claim 1 wherein the trigger is covered with a film covering.

15. The apparatus of claim 14 wherein the film covering is made from Mylar.

16. The apparatus of claim 1 wherein the timer comprises a microprocessor, a light emitting diode display, a plurality of light emitting diodes, a reset switch, a power switch, and a power source.

17. The apparatus of claim 1 wherein the timer includes a delay to prevent errant starting signals.

18. The apparatus of claim 17 wherein the delay ranges from about 0.1 seconds to about 0.5 seconds.

19. The apparatus of claim 17 wherein the delay ranges from about 0.01 seconds to about 0.5 seconds.

20. An apparatus for timing cup stacking competitions comprising:

a mat;

a plurality of triggers connected to the mat;

a timer operatively connected to the plurality of triggers wherein a first substantially simultaneous activation of at least two of the plurality triggers starts the timer and a second substantially simultaneous activation of at least two of the plurality triggers stops the timer.

21. The apparatus of claim 20 wherein the plurality of triggers can be activated in parallel or in series.

22. The apparatus of claim 20 wherein the trigger and the timer are incorporated into the mat to form a integral unit.

23. An apparatus for timing cup stacking competitions comprising:

support means;

a first trigger means connected to said support means, wherein the first trigger means is unaffected by the cup stacking;

a second trigger means connected to said support means, wherein the second trigger means is unaffected by the cup stacking;

timing means operatively connected to said trigger means, wherein the timing means is activated and deactivated by substantially simultaneous contact of the first trigger and the second trigger.

24. The apparatus according to claim 23 wherein the trigger means is a capacitive switch, an inductive switch, a dry contact switch, a photo optic switch, a photo electric switch, a pressure sensitive switch, or any combination of these.

25. The apparatus according to claim 23 wherein the support means is a mat, a cushion, a rug, or any combination of these.

26. The apparatus according to claim 23 wherein the trigger means and timer means are incorporated into the support means to form an integral unit.

27. The apparatus of claim 23 wherein the trigger means is comprised of a plurality of switches operated in parallel or in series.

28. The apparatus of claim 23 wherein the support means has a non-slip surface on one side and a smooth, even surface on the reverse side.

29. The apparatus of claim 23 wherein the support means is made from fabric, fabric with a substrate, fabric with a backing, short nap carpet, closed cell foam, vinyl with a substrate or any combination of these.

30. The apparatus of claim 23 wherein the support means is comprised of a foam substrate and a fabric surface.

31. The apparatus of claim 30 wherein the fabric surface of the support means is a polyester fabric or a flocked fabric.

32. The apparatus of claim 30 wherein the fabric surface is imprinted with a design.

33. The apparatus of claim 23 wherein the trigger is covered with a film covering.

34. The apparatus of claim 33 wherein the film covering is made from Mylar.

35. The apparatus of claim 23 wherein the timer comprises a microprocessor, a light emitting diode display, a plurality of light emitting diodes, a reset switch, a power switch, and a power source.

36. The apparatus of claim 23 wherein the timer includes a delay to prevent errant starting signals.

37. The apparatus of claim 36 wherein the delay ranges from about 0.1 seconds to about 0.5 seconds.

38. The apparatus of claim 36 wherein the delay ranges from about 0.01 seconds to about 0.5 seconds.

39. The apparatus of claim 1 wherein the trigger is selectively connected to the mat such that it may be easily replaced or transferred to another mat.

40. The apparatus of claim 1 wherein the timer is selectively connected to the mat such that it may be easily replaced or transferred to another mat.

41. The apparatus of claim 1, wherein the timer includes at least one wire for connection to the mat such that the timer may be placed a predetermined distance from the mat during the cup stacking competition, and wherein a readout display may be viewed by a plurality of individuals.

42. A method of timing competition having tasks to be completed comprising:

arming a trigger that comprises a plurality of pads that are connected to a mat and operatively connected to a timer;

starting the timer by interaction with at least two of the plurality of pads by a single individual;

completing a cycle stack of a plurality of cups on the mat; and stopping the timer.

43. A method of timing competition having tasks to be completed comprising:

arming a trigger that comprises a plurality of pads that are connected to a mat and operatively connected to a timer;

starting the timer by interaction with at least two of the plurality of pads by a single individual;

completing at least one of a 3-6-3, a 1-10-1, a 3-3-3, a 10-15, a 6-6 and a 15-21 stack of a plurality of cups on the mat; and stopping the timer.

* * * * *